US007731379B2

(12) United States Patent
Wakalopulos

(10) Patent No.: US 7,731,379 B2
(45) Date of Patent: Jun. 8, 2010

(54) HAND HELD, HIGH POWER UV LAMP

(75) Inventor: George Wakalopulos, Pacific Palisades, CA (US)

(73) Assignee: Adastra Technologies, Inc., Torrance, CA (US)

( * ) Notice: Subject to any disclaimer, the term of this patent is extended or adjusted under 35 U.S.C. 154(b) by 0 days.

(21) Appl. No.: 12/209,080

(22) Filed: Sep. 11, 2008

(65) Prior Publication Data

US 2009/0273266 A1 Nov. 5, 2009

Related U.S. Application Data

(63) Continuation-in-part of application No. 12/112,753, filed on Apr. 30, 2008.

(51) Int. Cl.
*F21V 29/00* (2006.01)

(52) U.S. Cl. ..... 362/109; 118/620; 118/624; 362/230; 362/373; 362/294

(58) Field of Classification Search ..... 362/109, 362/230, 296.01, 373, 294; 118/620–642
See application file for complete search history.

(56) References Cited

U.S. PATENT DOCUMENTS

| | | | | |
|---|---|---|---|---|
| 2,777,091 | A | 1/1957 | Rixton | |
| 4,070,398 | A | 1/1978 | Lu | |
| 4,105,118 | A | 8/1978 | Williams, Jr. et al. | |
| 4,701,766 | A | 10/1987 | Sugitani et al. | |
| 5,003,185 | A | 3/1991 | Burgio, Jr. | |
| 5,259,169 | A | 11/1993 | Appelbaum et al. | |
| 5,816,692 | A * | 10/1998 | Cooper et al. | 362/293 |
| 6,361,194 | B1 | 3/2002 | Evans et al. | |
| 6,571,953 | B2 | 6/2003 | Sherline et al. | |
| 6,716,305 | B2 | 4/2004 | Green et al. | |
| 6,739,716 | B2 | 5/2004 | Richards | |
| 6,783,263 | B1 | 8/2004 | Cronk | |
| 6,953,940 | B2 | 10/2005 | Leighley et al. | |
| 7,344,272 | B2 | 3/2008 | Cooper et al. | |
| 2003/0067768 | A1 * | 4/2003 | Shiau et al. | 362/184 |
| 2003/0178928 | A1 | 9/2003 | Becker et al. | |
| 2004/0011970 | A1 * | 1/2004 | Kalley et al. | 250/504 R |
| 2004/0027075 | A1 | 2/2004 | Hataoka et al. | |
| 2004/0071891 | A1 | 4/2004 | Luka | |
| 2004/0251849 | A1 | 12/2004 | Harada et al. | |
| 2008/0030115 | A1 | 2/2008 | Erofeev et al. | |

* cited by examiner

*Primary Examiner*—Laura Tso
(74) *Attorney, Agent, or Firm*—Schneck & Schneck; Thomas Schneck

(57) ABSTRACT

A hand held UV lamp and beam generator has resistive ballast provided by a glowing wire and thermal ballast provided by heated air coming via the same hot wire. A detachable reflector housing has curved symmetric spars in a generally parabolic shape defining an axis with an elongated axially lamp at a focal line. Heated air flows through the spars heating the lamp in a start mode and cooling the lamp in a run mode. The lamp and beam generator is made from electrical components found in a household hair dryer.

43 Claims, 3 Drawing Sheets

HAND HELD, HIGH POWER UV LAMP

CROSS-REFERENCE TO RELATED APPLICATION

This application is a continuation-in-part of prior application Ser. No. 12/112,753, filed Apr. 30, 2008 for "Gas Cooled Reflector Structures for Axial Lamp Tube" by George Wakalopulos.

TECHNICAL FIELD

The invention relates to portable, moderately high power, ultraviolet lamps.

BACKGROUND OF THE INVENTION

Beams of high intensity UV light are useful for curing polymers in coatings, inks, adhesives and the like, and for other purposes. A known reliable source of UV light at good power is the mercury vapor street light. Typical power is 175 watts per inch available a few minutes after starting. At start-up a small pool of mercury is vaporized and heated. The lamp is a negative resistance device requiring ballast to prevent increasing current from damaging the lamp. The negative resistance is offset by a positive impedance that tends to limit current. As the lamp heats up during operation, internal gas pressure rises and a higher voltage is required to maintain the discharge. The resistive drop across the ballast supplies the required voltage until the required voltage cannot be supplied to maintain the discharge. At that point, the discharge is extinguished, the lamp cools, the gas pressure is reduced and the ballast is again effective once the lamp is started. An auxiliary high voltage electrode is used to restart the arc discharge. In the prior art, filaments of incandescent lamps have been placed in series with filaments of UV germicidal lamps as electrical ballast in household clothes dryers.

For UV beams with high power, say over 100 watts per inch with a beamwidth of 1 to 5 inches at a distance from the beam of one or two inches, large housings are used to provide room for both circuitry, lamp and any cooling structures. What is needed is a hand held structure that will hold apparatus for a moderate power UV beam device. A hand held device offers speed and precision for curing of polymer coating on surfaces of all shapes.

SUMMARY OF INVENTION

The above object has been met with a hand held ultraviolet beam generator formed by detachably joining a shell housing and a lamp housing. The shell housing has a grip handle connected to a body portion with thermal and electrical ballast for a lamp mounted within the shell housing. On the other hand, the lamp housing, generally perpendicular to the grip handle, has an elongated reflector with a central access and an axially mounted ultraviolet lamp supported in the reflector and connected to the electrical ballast. The electrical ballast is preferably a Nichrome wire of the type found in a common hair dryer, providing resistive ballast. Air from the fan is blown across the wire in a path that takes the air past the lamp. The reflector is split so that air can enter a plenum defined by the reflector wherein the lamp is mounted. When the lamp is cold, heated air passing over the resistive wire heats the lamp toward its operating temperature. When the lamp temperature exceeds the temperature of the wire the air cools the lamp tending to stabilize thermal performance.

BEST MODE OF THE INVENTION

Figure 1:
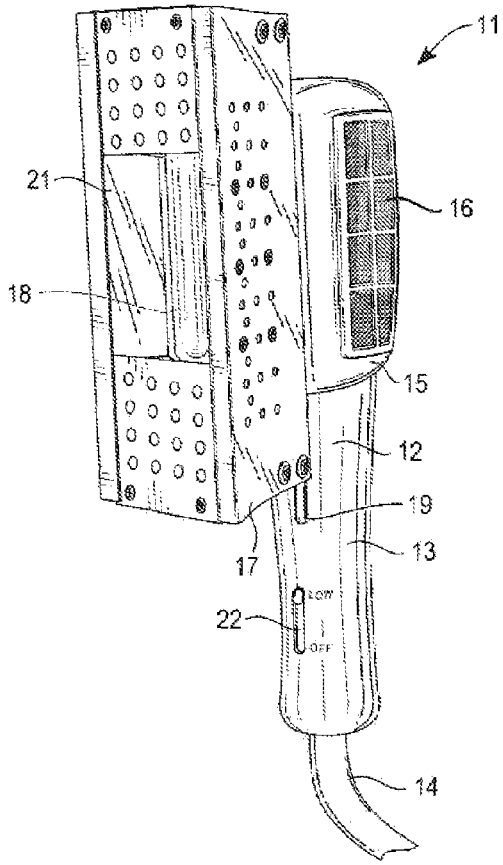
FIG. 1 is a perspective view of a hand held ultraviolet beam generator in accordance with the present invention.

With reference to FIG. 1, a hand held beam generator 11 is shown having a shell housing 12 and a lamp housing 17. The shell housing 12 has a handle 13 and a body portion 15. The body portion 15 and the handle 13 are connected together in the vicinity of a trigger switch 19 which controls power on and off to the unit. The shell housing 12 includes an air intake port 16 that allows outside air to pass into the shell housing under power of a motor, not shown. The lamp housing 17 is detachably connected to body portion 15, by means of screws. The lamp housing includes a reflector module 21 that defines a space or plenum where ultraviolet lamp 18 is mounted. The reflector is axially symmetric relative to the ultraviolet lamp 18 which in the case of a parabolic reflector resides along a focal line, allowing a collimated beam to be formed by the reflector. As will be seen below, the reflector module is made from symmetric halves with an air gap between the halves that allows air from the shell housing to pass into the plenum to influence the temperature of lamp 18. A secondary switch 22 may be used to control the speed of the motor. An electrical power cord 14 feeds ordinary AC power to the motor in the shell housing.

Figure 2:
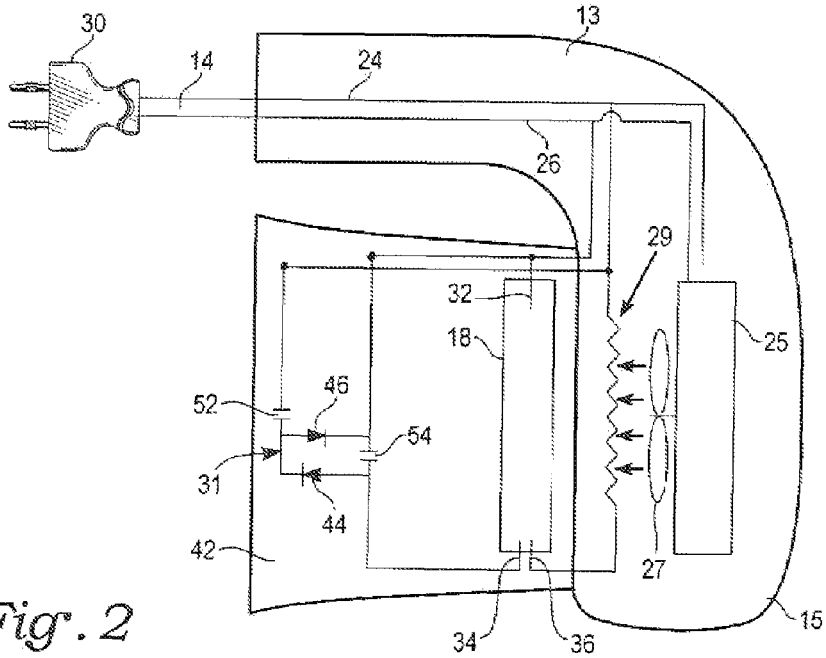
FIG. 2 is an electrical plan view of the apparatus of FIG. 1.

With reference to FIG. 2, electrical cord 14 is seen to be terminated at an AC plug 30 and has a pair of wires 24 and 26 connected to AC motor 25 which drives fan 27. Wires 24 and 26 are also connected to the lamp 18 by means of electrodes 32, 34, and 36. Separating the contacts between electrodes 32 and 36 is a ballast resistor 29 which is a Nichrome wire of the type found in hair dryers. Fan 27 directs air, indicated by arrows, through the Nichrome wires and towards the lamp 18. Electrodes 32 and 34 of the lamp are connected to a voltage multiplier circuit 31 which serves as a starter for the lamp. Diodes 44 and 46 are oppositely biased at opposite plates of a first capacitor 54 while a second capacitor 52 forms a quasi-bridge circuit for voltage multiplication. The circuit draws little current but high voltage from the circuit allows ignition of a material such as molten mercury which will form an ionic plasma in lamp tube 18. The resistive ballast resistor 29 is used to counteract the negative resistance of the mercury vapor ultraviolet lamp 18. The ballast resistor 29 prevents the lamp from drawing excessive current and provides electrical stability as the lamp warms. However, the temperature of the lamp will exceed the temperature of the air being blown across it from heating of the ballast resistor. As the lamp continues to heat up during operation, internal gas pressure within the lamp tube causes a higher voltage to be required to maintain the arc discharge. The higher voltage is not available through the ballast circuit. Since the voltage necessary to maintain the arc exceeds the voltage provided by the electrical ballast, the arc fails. The lamp goes out and begins to cool down. As gas pressure in the tube goes down, liquid mercury will form and the high voltage multiplier circuit 42 can be used to ignite the arc and send current into ballast resistor 29, plus heat blown across the Nichrome wire resistor 29. This heats the lamp causing the lamp to glow and produce infrared light once again. This on-off cycle is inherent in the performance of the lamp and allows relatively high intermittent power to be obtained from a simple circuit.

Figure 3:
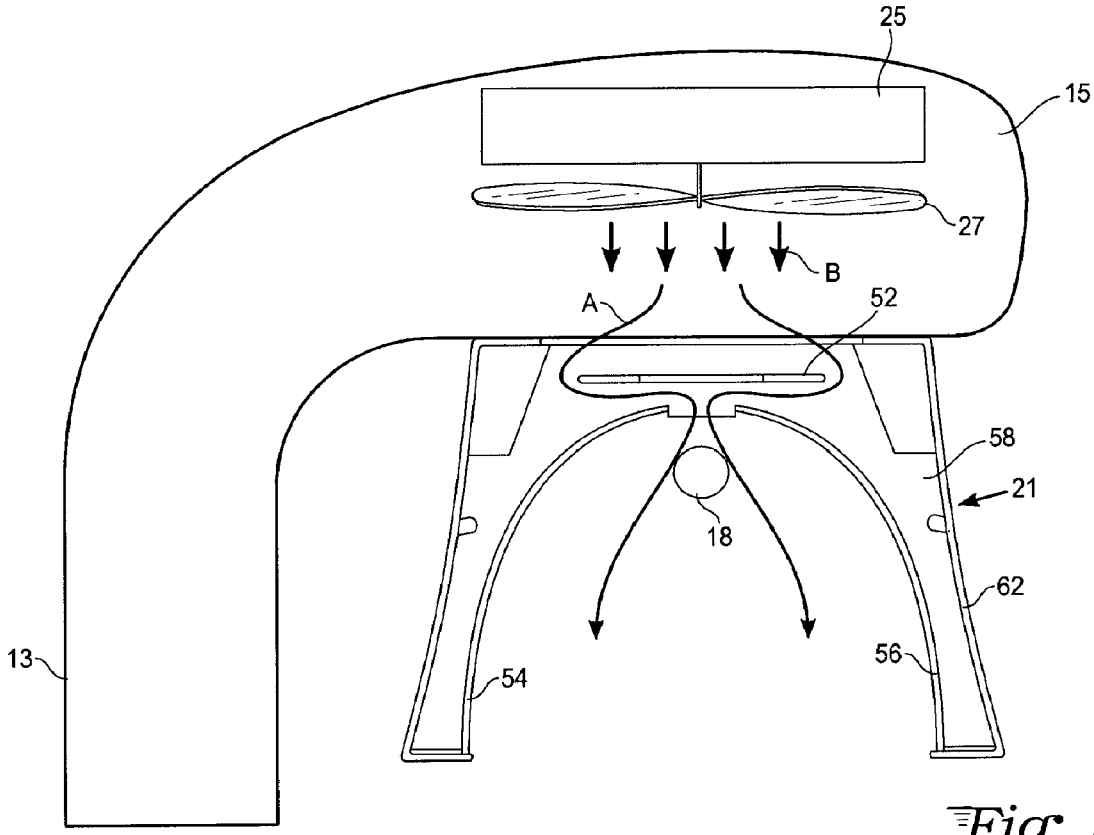
FIG. 3 is a mechanical and thermal plan view of the apparatus of FIG. 1.

With reference to FIG. 3, an air flow path, designated by A, is shown to start below fan 27 where air current indicated by the arrows B exists. Fan 27 is driven by motor 25 within the body 15 of the shell housing. The air enters a parabolic reflector module 21 through an opening at the top of the reflector module and must skirt a deflector 52 before entering a plenum between the opposed reflective spars 54 and 56. At the focal line of the parabolic shape is ultraviolet lamp 18. It will be seen that the air stream A, passing around deflector 52 and entering the plenum passes directly around ultraviolet lamp 18 either heating the lamp in a startup mode or cooling the lamp in the run mode. The reflective spars are held in place by ribs, such as rib 58, which are longitudinally spaced along the length of the reflector module 21 and supported by reflective housing 62. The entire apparatus may be gripped by handle 13, with light emerging as a collimated beam.

Figure 4:
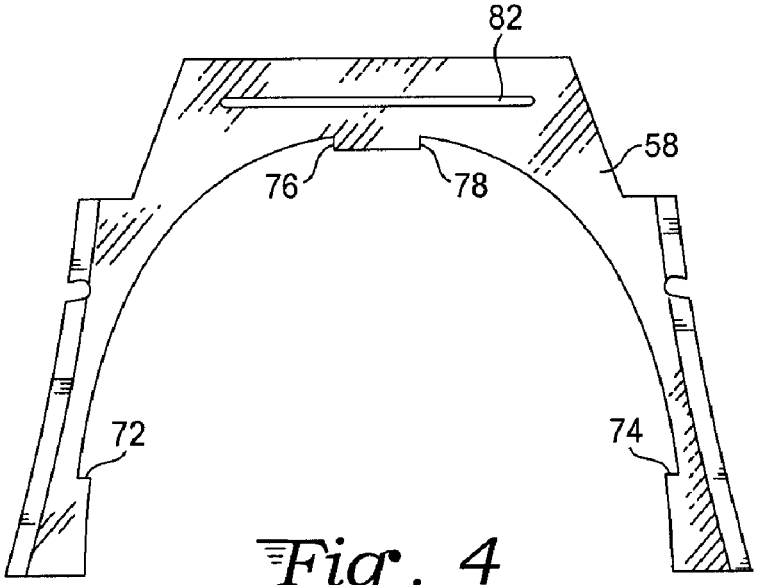
FIG. 4 is a side view of a rib used for supporting the reflector structure shown in FIG. 1.

With reference to FIG. 4, a rib 58 is seen having internal ridges 72 and 74 at the lower end and 76 and 78 at the upper end. In addition, a slot 82 near the top of rib 58 is provided to accommodate a deflector strip. The curved region between ridges 72 and 76 is parabolic in shape. Similarly, the curve between ridges 74 and 78 is bilaterally symmetric with the curve between ridges 72 and 76. Accordingly, both are parabolic, a preferred but not an essential shape.

Figure 5:
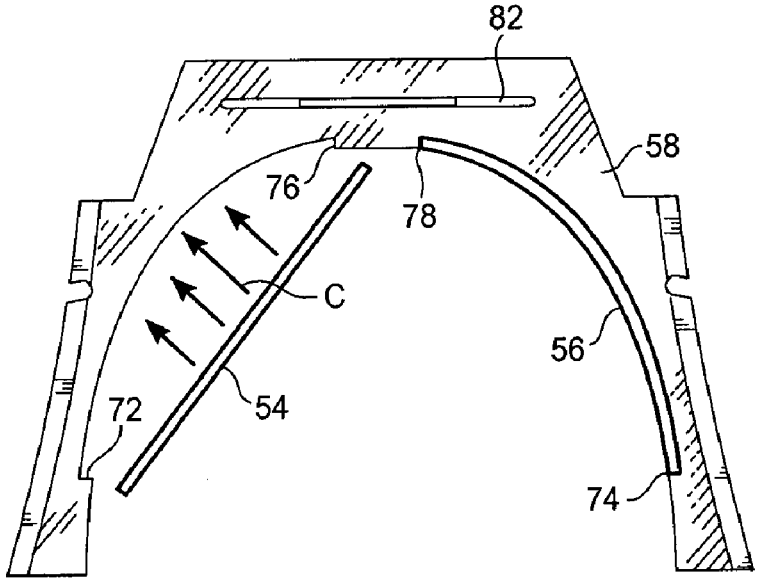
FIG. 5 is a side plan view showing the method of mounting reflector spars in the rib of FIG. 4.

In FIG. 5, reflective spars 54 and 56 are seen to be pushed against the parabolic shape of rib 58. Reflective spar 56 is seen to be held between ridges 74 and 78 while reflective spare 54 is seen to be moving during installation in the direction of arrows C so that it will be bent to follow the curvature of rib 58 between ridges 72 and 76. Thus, each spar is flexed and held by spring tension between opposed ridges, with the length of the spar being made to exactly follow the curvature of the rib against of which it is placed.

Figure 6:
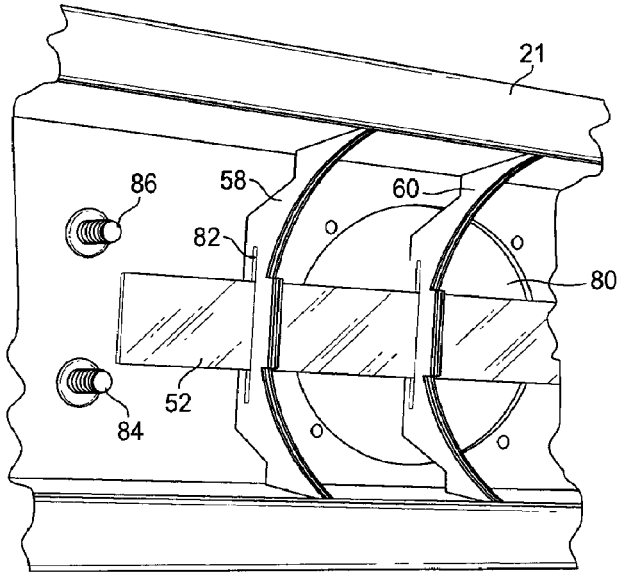
FIG. 6 is a bottom perspective view of a lamp housing, shown in FIG. 1, with ribs and an air deflector mounted in the housing.

With reference to FIG. 6, a pair of ribs 58 and 60 are seen to be spaced apart. A deflector 52 is seated in the upper slot, such as slot 82 of rib 58. Reflective spars have not yet been seated in the assembly process. It is seen that opening 80 allows air to enter the reflector module 21 through opening 80. Fasteners 84 and 86 attach the reflector module 21 to the body of a hand held beam generator.

In operation, an arc is ignited by operation of the voltage multiplier while at the same time the ballast resistor is rapidly rising to a temperature of almost 1000° Fahrenheit. Air flow across the resistor is used to heat the lamp and even though the lamp has negative resistance, the positive voltage drop across the ballast resistor provides appropriate current to maintain the arc and obtain high power light output. A 175 watt mercury vapor lamp can produce an output beam of over 100 watts. It has been found that ordinary hair dryers contain components suitable for use including a Nichrome wire which becomes the ballast resistor and an AC motor with an appropriate fan for blowing air across the Nichrome wire. In fact, every component of an ordinary household hair dryer can be used in manufacturing the hand held ultraviolet beam generator of the present invention. Only the voltage multiplier circuit, lamp, and reflectors need to be added. The beam is directed toward a surface to be cured and because of light weight, the beam may be swept across a surface using the grip handle, safely reaching corners and crevices which may be difficult to reach with heavier equipment. The lamp housing is designed so that the lamp is shaded by its reflector so that UV light from the lamp cannot be viewed, except where the beam emerges.

What is claimed is:

1. A hand held ultraviolet beam generator comprising:

a shell housing having a body and a handle connected to the body;

electrical and thermal ballast for a lamp within the shell housing;

a lamp housing detachably connected to the shell housing and having a reflector with an axis and an axially mounted ultraviolet lamp therein and connected to the electrical ballast;

the thermal ballast having a heater element and a fan with the fan blowing air from the heater element over the lamp; and wherein light reflected from the reflector forms an ultraviolet beam.

2. The apparatus of claim 1 wherein the electrical ballast is resistive.

3. The apparatus of claim 1 wherein the heater element is a Nichrome wire element.

4. The apparatus of claim 1 wherein the ultraviolet lamp is a mercury lamp of the type used for street lights.

5. The apparatus of claim 1 further comprises a trigger switch connected to the handle.

6. The apparatus of claim 1 wherein the shell housing and the electrical and thermal ballast comprises a hair dryer.

7. The apparatus of claim 1 wherein the reflector is provided with at least one opening for allowing the blowing air to reach the lamp.

8. The apparatus of claim 1 wherein the reflector is axially split into symmetric halves.

9. The apparatus of claim 8 wherein the axially split reflector halves are parabolic in shape.

10. The apparatus of claim 9 wherein the axially split reflector halves are supported by spaced apart ribs mounted on the lamp housing.

11. The apparatus of claim 1 wherein the ultraviolet lamp is a 3-electrode lamp.

12. The apparatus of claim 11 wherein one of said 3-electrodes is connected to a high voltage start circuit.

13. A method of making a hand held UV beam generator comprising:

providing electrical and thermal ballast for a UV lamp within a hand held housing;

placing a UV lamp in electrical and thermal communication with the electrical and thermal ballast; and placing a beam forming reflector around a portion of the UV lamp.

14. The method of claim 13 further defined by forming the hand held housing with an outer shell having a handle, a body connected to the handle and a switch.

15. The method of claim 14 further defined by using the body of the shell for supporting said UV lamp and the reflector.

16. The method of claim 15 further defined by obtaining the UV lamp from a 3-electrode lamp in a bulb having regular use as a street light.

17. The method of claim 16 wherein the 3-electrode lamp is a mercury vapor lamp.

18. The method of claim 16 further defined by providing a voltage multiplier in a circuit having the electrical ballast and connecting the voltage multiplier to a first and second electrode of the 3-electrode UV lamp.

19. The method of claim 18 further defined by providing a household electrical cord in communication with the switch and with the circuit.

20. The method of claim 14 further defined by providing the UV lamp as a lamp having an elongated axis and providing an axially split parabolic reflector for the lamp supported by the body, the split allowing gas interchange with the lamp from behind the reflector.

21. The method of claim 20 further defined by establishing a gas flow path from the body through the reflector, thereby communicating gas to the lamp.

22. The method of claim 13 wherein the step of providing electrical components of the type found in a hand held hair dryer comprises using a heater element as resistive ballast and using a blower and the heater element as thermal ballast.

23. An ultraviolet beam generator comprising:

a shell housing having a body;

a lamp housing detachably connected to the shell housing and having a reflector with an axis and an axially mounted ultraviolet lamp therein;

an electrical an thermal wire ballast element connected to the lamp, the thermal wire ballast element being a heater element having an associated fan blowing air over the wire heater element and over the lamp; and wherein light reflected from the reflector forms an ultraviolet beam emerging from the lamp housing.

24. The apparatus of claim 1 wherein the lamp has a negative resistance property and the thermal wire ballast has a resistance offsetting the negative resistance property of the lamp.

25. The apparatus of claim 1 wherein the thermal wire ballast is a Nichrome wire element.

26. The apparatus of claim 1 wherein the ultraviolet lamp is a mercury lamp of the type used for street lights.

27. The apparatus of claim 1 further comprises a trigger switch and a handle connected to the body, the handle allowing the beam generator to be hand held.

28. The apparatus of claim 1 wherein the shell housing and the electrical and thermal ballast comprises components of a hair dryer.

29. The apparatus of claim 1 wherein the reflector is provided with at least one opening for allowing the blowing air to reach the lamp.

30. The apparatus of claim 1 wherein the reflector is axially split into symmetric halves.

31. The apparatus of claim 8 wherein the axially split reflector halves are parabolic in shape.

32. The apparatus of claim 9 wherein the axially split reflector halves are supported by spaced apart ribs mounted on the lamp housing.

33. The apparatus of claim 1 wherein the ultraviolet lamp is a 3-electrode lamp.

34. The apparatus of claim 11 wherein one of said 3 electrodes is connected to a high voltage start circuit.

35. A method of making a UV beam generator comprising:

providing an electrical heater wire as electrical and thermal ballast for a UV lamp;

placing a UV lamp in electrical and thermal communication with the electrical and thermal ballast; and placing a beam forming reflector around a portion of the UV lamp.

36. The method of claim 13 further defined by providing a hand held outer shell having a handle, a body connected to the handle and a switch as a housing for said electrical heater wire.

37. The method of claim 14 further defined by using the body of the shell for supporting said UV lamp and the reflector.

38. The method of claim 15 further defined by obtaining the UV lamp from a 3-electrode lamp in a bulb having regular use as a street light.

39. The method of claim 16 wherein the 3-electrode lamp is a mercury vapor lamp.

40. The method of claim 16 further defined by providing a voltage multiplier in a circuit having the electrical ballast and connecting the voltage multiplier to a first and second electrode of the 3-electrode UV lamp.

41. The method of claim 18 further defined by providing a household electrical cord in communication with the switch and with the circuit.

42. The method of claim 14 further defined by providing the UV lamp as a lamp having an elongated axis and providing an axially split parabolic reflector for the lamp supported by the body, the split allowing gas interchange with the lamp from behind the reflector.

43. The method of claim 20 further defined by establishing a gas flow path from the body through the reflector, thereby communicating gas to the lamp.

* * * * *